United States Patent [19]

Piramoon et al.

[11] Patent Number: 4,738,656

[45] Date of Patent: Apr. 19, 1988

[54] COMPOSITE MATERIAL ROTOR

[75] Inventors: Alireza Piramoon, Santa Clara; Robert Carey, Portola Valley, both of Calif.

[73] Assignee: Beckman Instruments, Inc., Fullerton, Calif.

[21] Appl. No.: 849,911

[22] Filed: Apr. 9, 1986

[51] Int. Cl.[4] ..... B04B 7/08

[52] U.S. Cl. ..... 494/81; 494/16

[58] Field of Search ..... 494/81, 43, 16, 17; 15/230.14, 230.12; 127/56; 210/360.1

[56] References Cited

U.S. PATENT DOCUMENTS

| | | | |
|---|---|---|---|
| 1,827,648 | 10/1931 | Greene | 494/81 |
| 2,974,684 | 3/1961 | Ginaven | 494/81 |
| 3,913,828 | 10/1975 | Roy | 494/81 |
| 3,993,243 | 11/1976 | Dietzel | 494/36 |
| 3,997,106 | 12/1976 | Baram | 494/81 |
| 4,160,521 | 7/1979 | Lindgren | 494/81 |

*Primary Examiner*—Robert W. Jenkins

*Attorney, Agent, or Firm*—William H. May; Paul R. Harder

[57] ABSTRACT

A composite material rotor is disclosed which is made from a plurality of stacked and bonded epoxied filament wound discs, each disc providing a specially wound construction so that the modulus of the rotor body may be varied in proportion to the maximum stress encountered by the rotor during ultracentrifugation. Such a layered disc assembly allows the rotor to be fine-tuned to respond to a variety of stress encountered during ultracentrifugation. Where upper hoop stress is greater, upper disc 28 might be wound using a higher modulus filament fiber than the fiber used by disc 26.

12 Claims, 2 Drawing Sheets

COMPOSITE MATERIAL ROTOR

FIELD OF THE INVENTION

This invention relates to ultra high speed centrifuge rotors and in particular to a composite material rotor of lower density and higher strength of materials.

BACKGROUND OF THE INVENTION

An ultracentrifuge rotor may experience 600,000 g or higher forces which produce stresses on the rotor body which can eventually lead to rotor wear and disintegration. All ultracentrifuge rotors have a limited life before damage and fatigue of the material comprising the rotor mandates retirement from further centrifuge use.

Stress generated by the high rotational speed and centrifugal forces arising during centrifugation is one source of rotor breakdown. Metal fatigue sets into conventional rotors following a repeated number of stress cycles. When a rotor is repeatedly run up to operating speed and decelerated, the cyclic stretching and relaxing of the metal changes its microstructure. The small changes, after a number of cycles, can lead to the creation of microscopic cracks. As use increases, these fatigue cracks enlarge and may eventually lead to rotor failure. The stress on conventional metal body rotors may also cause the rotor to stretch and change in size. When the elastic limits of the rotor metal body have been reached, the rotor will not regain its original shape, causing rotor failure at some future time.

Conventional titanium and aluminum alloy rotors have a respectably high strength to weight ratio. Aluminum rotors are lighter weight than titanium, leading to less physical stress and a lower kinetic energy when run at ultracentrifuge speeds; however, titanium rotors are more corrosive resistant than aluminum. As the ultracentrifuge performance and speeds increase, the safe operating limits of centrifugation are reached by conventional dense and high weight metal rotors.

One attempt to overcome the design limitations imposed is indicated in U.S. Pat. No. 3,997,106 issued to Baram for a centrifuge rotor which is laminated and consists of two layers of different materials. Wires (24) are wound around a metal cover **8*b*** which surrounds a central filler of chemically resistant plastics (See FIG. 3 of the '106 patent). The Baram '106 patent envisions greater chemical resistance and lower specific gravity rotors, which achieve optimum strength, by the use of a laminate manufacturing process. U.S. Pat. No. 2,974,684 to Ginaven (2,974,684) is directed to a wire mesh of woven wire cloth 6 for reinforcing a plastic material liner 7 for use in centrifugal cleaners (see FIGS. 2 and 3).

U.S. Pat. Nos. to Green (1,827,648), Dietzel (3,993,243) and Lindgren (4,160,521) have all been directed to a rotor body made from resin and fibrous reinforcement materials. In particular, Green '648 is fibre wound to produce a moment of inertia about the vertical axis greater than the moment of inertia about the horizontal axis through the center of gravity of the bucket so that the rotor bucket is stable at speeds of 7500 to 10,000 RPM (a relatively slow centrifuge speed by modern standards).

U.S. Pat. No. 4,468,269, issued Aug. 28, 1984 to the assignee of this application, discloses an ultracentrifuge rotor comprising a plurality of nested rings of filament windings surrounding the cylindrical wall of a metal body rotor. The nested rings reinforce the metal body rotor and provide strengthening and stiffening of the same. The rings are nested together by coating a thin epoxy coat between layers. U.S. Pat. No. 3,913,828 to Roy discloses a design substantially equivalent to that disclosed by the '269 patent.

None of the conventional designs provide maximum strength through ultracentrifuge speeds through the use of a material specifically designed to accommodate localized stress and resist rotor body fatigue. Conventional metal bodies, or reinforced metal body rotors, are subject to metal stress and fatigue failures during centrifugation.

What is needed is a rotor body of substantial strength, yet lighter in weight and capable of enduring increasingly higher loads and speeds. The body should resist stress and corrosion and be specifically designed to cope with localized stress.

SUMMARY OF THE INVENTION

Disclosed herein is a centrifuge rotor body made from a plurality of layers of anisotropic material. (As used in this application, the term "anisotropic" shall mean a material having properties, such as bulk modulus, strength, and stiffness, in a particular direction.) Each layer has a different modulus of strength, fine tuned to accommodate the particular stress which said layer would encounter, based on the shape, load at the design speed, or size of the rotor.

In each of the particular layers, selected portions of the material is oriented in a direction distinct from the main body of that layer, to reinforce and accommodate excessive stress formed at the test tube receiving cavity of the rotor.

In the preferred embodiment, the anisotropic material layers are made of a fibrous filament wound composite material, where the fiber is graphite and the resin epoxy. Each of the layers form a composite material disc and each disc extends radially from the central axis of the rotor, each disc being secured to other discs by an epoxy bonding.

DETAILED DESCRIPTION OF THE PREFERRED EMBODIMENT

Figure 1:
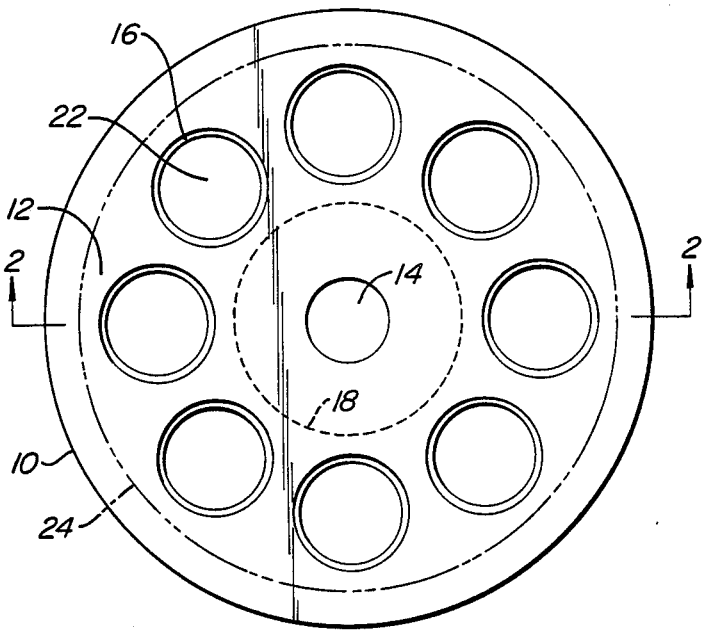
FIG. 1 is a top plan view of the composite rotor of this invention.
Figure 2:
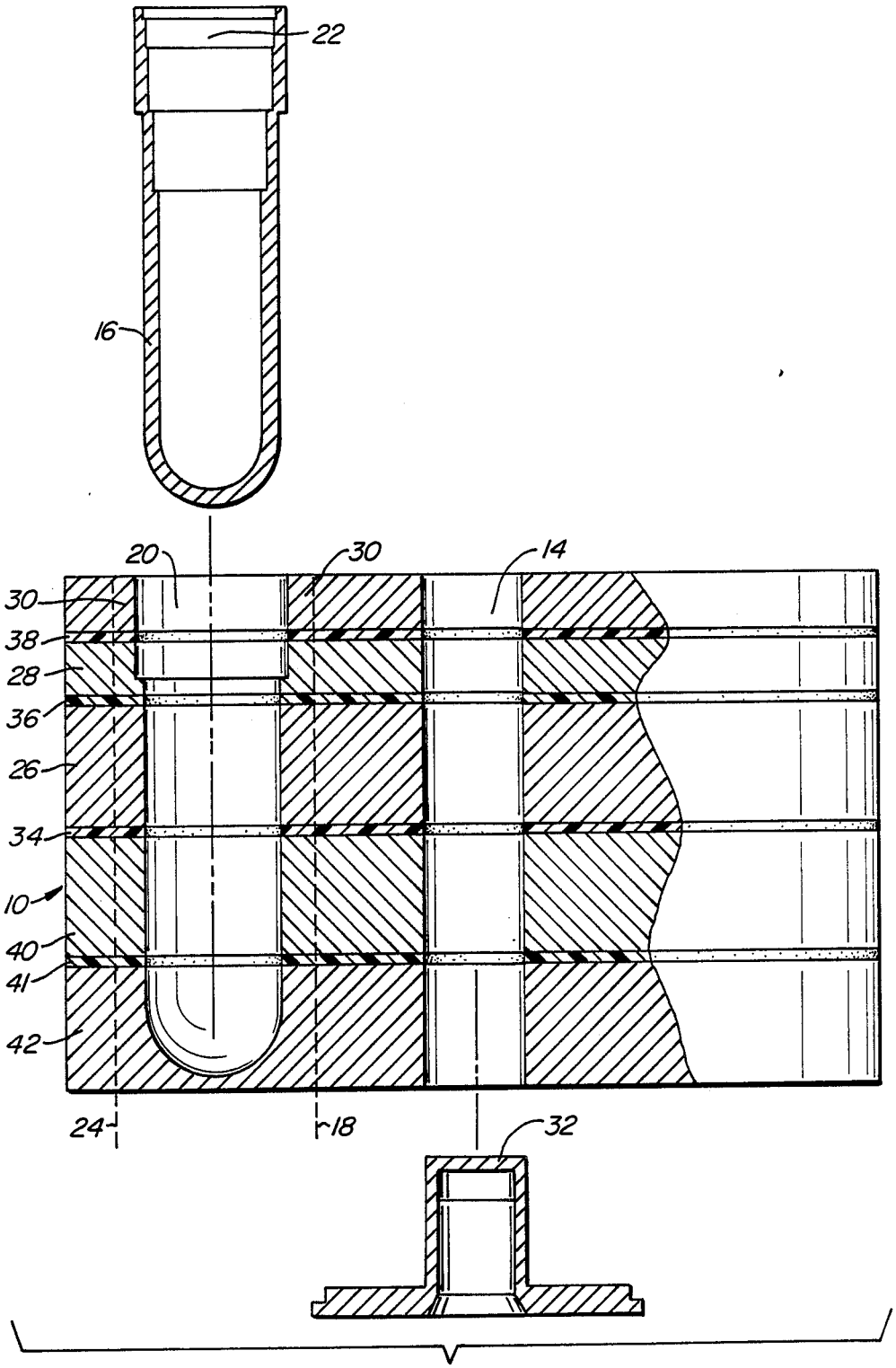
FIG. 2 is an elevated vertical cross-sectional view of the composite material rotor of this invention.

With reference to FIGS. 1 and 2, there is shown generally a composite material rotor 10 (FIG. 2). The rotor 10 is constructed from a plurality of layered discs, like 26 and 28 (FIG. 2).

The composite material selected for the composition of the rotor of the preferred embodiment includes (but is not limited to) graphite fiber filament wound into epoxy resin or a thermoplastic or thermoset matrix. The fiber volume is in excess of 60%. This composition has a density of approximately 0.065 lb/in$^3$, which is favorable when compared to conventional rotor designs including aluminum (0.11 lb/in$^3$) and titanium (0.16 lb/in$^3$). Alternative fiber filaments include glass, boron, and graphite. The fibrous material KEVLAR fiber, an organic fiber made by DuPont, is also a useful substitute for graphite.

Due to the high stress created by the ultracentrifuge, material selection has been influenced by the need for an "anisotropic" material such as graphite composite filament wound material.

In the preferred embodiment, a vertical tube rotor 10 is illustrative of the principles of the design of the subject invention.

Referring to the top plan view of the rotor 10 illustrated in FIG. 1, the varying densities of the filament design of the rotor 10 is demarcated by circular boundary lines 24 and 18. The region inward from the perimeter of circle 18 to the boundary of rotor shaft cavity 14 is wound to be of similar density to the region beyond the outer limits of circular line 24. The region 12, between the circular boundary line 18 and 24, is characterized by a region of more densely wound filament, as illustrated at region 30 of FIG. 2. As the center of the rotor 10 accommodates the insertion from the rotor underside of the drive shaft 32 (FIG. 2) into rotor drive shaft cavity 14, the top surface of the rotor 10 accommodates the insertion of metal test tube inserts 16 down into the machined cavity 20. A test tube 22 is then inserted into the insert 16 for a snug fit into the body of the rotor 10.

In the vertical test tube rotor 10, as illustrated in FIGS. 1 and 2, the stress is maximum at the upper layer, especially region 30 of FIG. 2, where maximum stress is manifested as hoop stress. One test tube cap (made from aluminum, composite material, or rubber) is loaded into the top of the rotor, for each test tube. Screwing these caps into the rotor body causes additional stress to the rotor body at the point of cap insert.

A critical advantage to the use of composite material construction is that each layer, such as 26 and 28, forms a disc that is uniquely fine tuned so that the modulus of elasticity is adjusted to accommodate the particular stress presented to each of several locations within and about the rotor 10.

Each of the discs, such as 26 and 28, are filament-wound around a central core. The fiber filament is available in at least four types of sizes, one thousand, three thousand, six thousand, and twelve thousand fibers per bundle. The preferred embodiment utilizes a fiber bundle of twelve thousand filaments per bundle. The filament bundle is wound to provide a range of two to 10 pounds per bundle of tension depending upon which of the plurality of discs is being constructed. The average density of the composite material disc is 0.065 lbs/per cubic inch. Those discs experience greater stresses during operation of the rotor, like disc 28, are manufactured with a greater tensile strength than those discs, like disc 40, which undergoes lesser stresses.

Each disc is individually machined to form the cavities such as the machined cavity 20. Once formed, cured, and machined, the discs are stacked along the central axis running longitudinally along shaft cavity 14, and are secured together by layered application of resin epoxy, shown at 41, 34, 36, and 38, sandwiched between the layered discs 42, 40, 26, and 28. After the epoxy resin at 41, 34, 36, and 38 is applied between the disc layers the entire assembly is secondarily cured in an oven and the composite material rotor 10 is thereby manufactured.

Each disc is uniquely wound to particularly respond to the localized stresses which the assembled rotor will encounter during centrifugation. For example, disc 26 is formed and manufactured to accommodate localized stress which differs along the disc radius. Each disc may be made from a different grade or modulus strength fiber filament material. Also, the angle of the fiber windings may be changed from windings parallel to the horizontal plane. Around the core cavity 14, outward to circular boundary 18, the fiber is wound at 0° with respect to the horizontal plane of the rotor 10. As the filament is wound in the region between 18 and 24, the filament windings in this vicinity of the machined cavity 20 are deliberately wound at approximately a criss-crossed ±45° angle to the horizontal plane, to provide additional support to surround cavity 20. This criss-crossed stitching of the filament fiber in the region 12 (FIG. 1) between the boundaries 18 and 24 adds additional support to the cavity 20 to ensure that the material strength of the rotor will not be diminished by the presence of machined cavities such as 20. The optimum strength is obtained when the fiber is wound at an approximate angle of a criss-crossed ±45°; however, use of an angle range, if varied over 10° from a ±45° optimum value in either direction (from ±35° to ±55° angle from the horizontal), would achieve a superior strength over the horizontal winding.

Additionally, disc 28 and the disc atop it are manufactured from a stiffer, higher modulus, and strength filament material than the material used to produce layers 26 and b low to accommodate the area of maximum hoop stress at the top of this vertical tube rotor 10. Thus, not only would the orientation of the winding differ to accommodate higher stress around the cavity 20, but the material comprising the fiber of the filament wound discs would differ, as disc 26 differs from 28, to fine tune and vary the modules of the discs 26 and 28 to respond with differing modulus to the differing stresses, which the discs 26 and 28 would encounter. By having separate discs, the more expensive, stronger discs would only be used where needed. A plurality of discs allows a rotor to be specifically designed to resist greater localized stress only where it arises.

If a different design than a vertical tube rotor, such as a fixed angle rotor body, were contemplated, the maximum stress bearing discs might be situated about ⅔ of the way down the rotor body, since the location of maximum stress in a fixed angle rotor differs from the location of such maximum stress in a vertical tube rotor.

It is appreciated that the preferred embodiment anticipates the use of separate discs comprising the rotor body, rather than one continual winding defining the entire rotor. Such a unibody construction is contemplated to be within the scope of this invention, where the fiber is reoriented to accommodate greater stress as shown in FIG. 2 in the region between boundaries 24 and 18. However, the preferred embodiment envisions a plurality of bonded discs rather than a unitary body fiber wound body due to the apparent inability of a unibody rotor to overcome residual axially directed stress that arises when a fiber wound disc exceeds an empirically derived width. Also, a unitary body filament wound composite material rotor could not select a plurality of fibrous filaments for various sections of the rotor body.

While the invention has been described with respect to a preferred embodiment vertical tube rotor constructed as described in detail, it will be apparent to those skilled in the art that various modifications and improvements may be made without departing from the scope and spirit of the invention. Accordingly, it will be understood that the invention is not limited by the specific illustrative embodiment, but only by the scope of the appended claims.

What is claimed is:

1. A centrifuge rotor comprising:

a body having a plurality of anisotropic material layers comprising cured resin impregnated fiber discs with enhanced strength of material properties in the radial direction;

each layer having fiber of a particular modulus, said modulus being predetermined to accommodate the particular stress of each said layer during centrifuge operation of said rotor stressing said discs radially.

2. The centrifuge rotor of claim 1, wherein each of said layers is a fiber filament wound composite material radially extending disc, each of said discs being secured together by resin, layer to layer.

3. The centrifuge rotor of claim 2, including a reorientation of the direction of the filament in selected anisotropic layers to accommodate the insertion and support of a plurality of test tubes.

4. The centrifuge rotor of claim 3, wherein the filament is reoriented at an angle to the horizontal plane of the rotor within a range of 35° to 55°.

5. The centrifuge rotor of claim 3, wherein the filament in selected anisotropic layers of the rotor is reoriented approximately at a 45° angle to the horizontal plane of the rotor.

6. The centrifuge rotor of claim 2 or 3, wherein the fiber filament is graphite and the resin is epoxy.

7. The centrifuge rotor of claim 2 or 3, wherein the resin has thermoplastic properties.

8. The centrifuge rotor of claim 2 or 3, wherein the resin has thermoset properties.

9. The centrifuge rotor of claim 2 or 3, wherein the fiber filament is a material selected from the group consisting of glass, boron, or graphite.

10. A centrifuge rotor comprising:

a body having at least one anisotropic material layer with enhanced strength of material properties in the radial direction;

said layer being a disc of radially extending material comprising filament wound fibers bonded by a resinous material;

said layer having the fibers which comprise the material of the disc being reoriented so that successive winds of said fiber criss-cross each other to provide additional strength of the material of the disc at selected locations where the greatest stress is anticipated.

11. The centrifuge rotor of claim 10, wherein the filament wound fibers criss-cross each other at a reorientation angle from a horizontal plane over a range of 35° to 55°.

12. The centrifuge rotor of claim 10, wherein the filament wound fibers criss-cross each other at a reorientation angle of approximately 45°.

* * * * *